US011468747B2

(12) United States Patent
Dryer et al.

(10) Patent No.: US 11,468,747 B2
(45) **Date of Patent: *Oct. 11, 2022**

(54) AUTOMATED EXCEPTION HANDLING FOR AUTOMATIC TELLER MACHINES

(71) Applicant: Bank of America Corporation, Charlotte, NC (US)

(72) Inventors: Eric Dryer, Charlotte, NC (US); Verlon Safold Watson, III, Charlotte, NC (US); Jordan Josiah Conklin, Huntersville, NC (US)

(73) Assignee: Bank of America Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/398,861

(22) Filed: Aug. 10, 2021

(65) Prior Publication Data

US 2021/0366245 A1 Nov. 25, 2021

Related U.S. Application Data

(63) Continuation of application No. 15/931,888, filed on May 14, 2020, now Pat. No. 11,120,670.

(51) Int. Cl.
*G07F 19/00* (2006.01)

(52) U.S. Cl.
CPC ..... *G07F 19/209* (2013.01); *G07F 19/203* (2013.01)

(58) Field of Classification Search
CPC ..... G07F 19/209; G07F 19/203
USPC ..... 235/379
See application file for complete search history.

(56) References Cited

U.S. PATENT DOCUMENTS

| | | | | |
|---|---|---|---|---|
| 5,253,167 | A | 10/1993 | Yoshida et al. | |
| 5,606,157 | A * | 2/1997 | Awatsu | G07F 19/20 235/379 |
| 5,799,288 | A * | 8/1998 | Tanaka | G07D 11/36 705/42 |
| 6,332,198 | B1 | 12/2001 | Simons et al. | |
| 6,470,018 | B1 | 10/2002 | Wiley et al. | |
| 6,560,241 | B2 | 5/2003 | Christie et al. | |
| 6,563,816 | B1 | 5/2003 | Nodoushani et al. | |
| 6,601,186 | B1 | 7/2003 | Fox et al. | |
| 6,639,912 | B1 | 10/2003 | Christie et al. | |
| 6,671,699 | B1 | 12/2003 | Black et al. | |
| 6,708,291 | B1 | 3/2004 | Kidder | |
| 6,876,652 | B1 | 4/2005 | Bell et al. | |
| 6,904,060 | B2 | 6/2005 | Nelson et al. | |
| 6,930,890 | B1 | 8/2005 | Branscomb | |
| 6,961,339 | B2 | 11/2005 | Christie et al. | |
| 6,983,362 | B1 | 1/2006 | Kidder et al. | |
| 6,993,011 | B1 | 1/2006 | Kaplan et al. | |
| 7,062,642 | B1 | 6/2006 | Langrind et al. | |

(Continued)

OTHER PUBLICATIONS

Dryer, E. et al., "Automated Exception Handling for Automatic Teller Machines," U.S. Appl. No. 15/931,888, filed May 14, 2020, 33 pages.

*Primary Examiner* — Paultep Savusdiphol

(57) ABSTRACT

An ATM exception handler automatically handles certain forms of exceptions. The exception handler receives messages indicating amounts of cash counted and amounts of cash shown at different ATMs. If exceptions are indicated by these messages, the exception handler attempts to reconcile exceptions with each other depending on several factors, such as, the servicer of the ATMs and day of servicing.

20 Claims, 3 Drawing Sheets

(56) References Cited

U.S. PATENT DOCUMENTS 7,093,750 B1 8/2006 Block et al.
7,158,524 B2 1/2007 Buyukkoc et al.
7,191,244 B2 3/2007 Jennings et al.
7,219,083 B2 5/2007 Bellucci et al.
7,222,147 B1 5/2007 Black et al.
7,225,240 B1 5/2007 Fox et al.
7,230,223 B2 6/2007 Jespersen et al.
7,280,529 B1 10/2007 Black et al.
7,289,511 B2 10/2007 Christie et al.
7,359,402 B2 4/2008 Gardner et al.
7,391,934 B2 6/2008 Goodall et al.
7,458,507 B2 12/2008 Fillinger et al.
7,474,330 B2 1/2009 Wren et al.
7,617,479 B2 11/2009 Hambrick et al.
7,693,974 B2 4/2010 Huang et al.
7,742,395 B1 6/2010 Chaudhuri et al.
7,881,453 B2 2/2011 Khuc et al.
7,894,422 B2 2/2011 Duree et al.
7,959,072 B1 6/2011 Jenkins et al.
8,078,518 B2 * 12/2011 Goertz ..... G07F 19/20 705/38
8,231,049 B2 7/2012 Agrawal
8,630,950 B2 1/2014 Saegert et al.
8,930,279 B2 1/2015 Hartmaier
9,101,890 B2 8/2015 Tonkovich et al.
9,159,058 B2 10/2015 Fleishman et al.
9,305,437 B1 * 4/2016 Koopman ..... G07F 19/203
9,311,674 B2 * 4/2016 Angus ..... G06Q 10/08
9,317,745 B2 4/2016 Smith et al.
9,591,360 B2 3/2017 Jennings et al.
9,676,976 B2 6/2017 Takeda et al.
10,290,052 B1 * 5/2019 Quesenberry ..... G06Q 40/00
10,353,689 B2 7/2019 Mishra et al.
10,395,199 B1 8/2019 Gibson et al.
2002/0107800 A1 * 8/2002 Kadowaki ..... G07D 11/32 705/43
2004/0215566 A1 10/2004 Meurer
2005/0173515 A1 * 8/2005 Sawa ..... G07F 19/207 235/379
2007/0069006 A1 * 3/2007 Holmes ..... G07F 7/084 235/379
2007/0131757 A1 6/2007 Hamilton et al.
2007/0151827 A1 * 7/2007 Brandstrom ..... G07F 19/203 194/206
2008/0237335 A1 * 10/2008 Sawa ..... G07F 9/026 235/379
2010/0042541 A1 2/2010 Kang et al.
2011/0307379 A1 * 12/2011 Fujita ..... G07F 7/1008 705/43
2014/0339301 A1 * 11/2014 Angus ..... G06Q 40/04 235/379
2015/0363755 A1 12/2015 Walden et al.
2015/0379489 A1 12/2015 Gopalakrishnan et al.
2016/0117893 A1 * 4/2016 Koopman ..... G07F 19/211 700/232
2017/0221295 A1 8/2017 Pont et al.
2019/0259094 A1 8/2019 Quesenberry et al.
2019/0370783 A1 12/2019 Aabye et al.

* cited by examiner

AUTOMATED EXCEPTION HANDLING FOR AUTOMATIC TELLER MACHINES

CROSS-REFERENCE TO RELATED APPLICATIONS

This application is a continuation of U.S. patent application Ser. No. 15/931,888 filed May 14, 2020, by Eric Dryer et al., and entitled "AUTOMATED EXCEPTION HANDLING FOR AUTOMATIC TELLER MACHINES," which is incorporated herein by reference.

TECHNICAL FIELD

This disclosure relates generally to exception handling in automatic teller machines (ATMs).

BACKGROUND

Automatic teller machines are used to hold and dispense cash.

SUMMARY OF THE DISCLOSURE

Automatic teller machines (ATMs) are machines that hold and dispense cash. Users may approach an ATM and withdraw cash from the ATM or deposit cash into the ATM. The ATM updates an account of the user depending on the actions taken by the user. ATMs typically include a physical repository within the ATM that stores the cash. The ATMs track the amount of money in the repository and update that amount depending on the transactions that have occurred at the ATM.

ATMs are serviced so that they do not run out of cash and so that deposited cash can be removed and taken to a processing facility. For example, servicers may drive armored trucks to ATMs to replenish the cash in the ATM and to remove deposited cash. These servicers may physically count the amount of cash in the ATM at the time of servicing and compare that amount to the amount of cash the ATM believes should be in the ATM based on the transactions that have occurred.

The servicers report the amount of cash counted and amount of cash shown by the ATM to an owner of the ATM to report the servicing. The owner of the ATM can then detect discrepancies between the amount of cash counted and the amount of cash shown. These discrepancies are a form of exception and should be handled and resolved. Servicers, however, may misreport the amount of cash counted and the amount of cash shown. Additionally, servicers may service ATMs in bulk (e.g., several ATMs at the same physical site) before reporting and, as a result, the servicer may attribute amounts of cash to the incorrect ATMs even though these amounts may be correct. As a result, it becomes technically challenging to determine when exceptions are truly exceptions and when they are false positives.

This disclosure contemplates an ATM exception handler that automatically handles certain forms of exceptions. The exception handler receives messages indicating amounts of cash counted and amounts of cash shown at different ATMs. If exceptions are indicated by these messages, the exception handler attempts to reconcile exceptions with each other depending on several factors, such as, the servicer of the ATMs and day of servicing. By reconciling exceptions with each other, the exception handler automatically detects and resolves false positives. Certain embodiments are described below.

According to an embodiment, an apparatus includes a memory and a hardware processor communicatively coupled to the memory. The hardware processor receives, from a servicer, a message indicating that a first amount of cash was counted in a first automatic teller machine and that the first automatic teller machine should contain a third amount of cash based on transactions processed by the first automatic teller machine and receives, from the servicer, a message that a second amount of cash was counted in a second automatic teller machine and that the second automatic teller machine should contain a fourth amount of cash based on transactions processed by the second automatic teller machine. The hardware processor also determines that the first amount of cash is different from the third amount of cash, determines that the second amount of cash is different from the fourth amount of cash, and determines that the first and second amounts of cash were counted by the servicer. In response to determining that the first amount of cash is different from the third amount of cash, that the second amount of cash is different from the fourth amount of cash, and that the first and second amounts of cash were counted by the servicer, the hardware processor determines that a difference between the first amount of cash and the third amount of cash is the same as a difference between the second amount of cash and the fourth amount of cash and in response to determining that the difference between the first amount of cash and the third amount of cash is the same as the difference between the second amount of cash and the fourth amount of cash, swaps the first and second amounts of cash.

According to another embodiment, a method includes receiving, by a hardware processor communicatively coupled to a memory and from a servicer, a message indicating that a first amount of cash was counted in a first automatic teller machine and that the first automatic teller machine should contain a third amount of cash based on transactions processed by the first automatic teller machine and receiving, by the hardware processor and from the servicer, a message that a second amount of cash was counted in a second automatic teller machine and that the second automatic teller machine should contain a fourth amount of cash based on transactions processed by the second automatic teller machine. The method also includes determining, by the hardware processor, that the first amount of cash is different from the third amount of cash, determining, by the hardware processor, that the second amount of cash is different from the fourth amount of cash, and determining, by the hardware processor, that the first and second amounts of cash were counted by the servicer. The method further includes, in response to determining that the first amount of cash is different from the third amount of cash, that the second amount of cash is different from the fourth amount of cash, and that the first and second amounts of cash were counted by the servicer, determining, by the hardware processor, that a difference between the first amount of cash and the third amount of cash is the same as a difference between the second amount of cash and the fourth amount of cash and in response to determining that the difference between the first amount of cash and the third amount of cash is the same as the difference between the second amount of cash and the fourth amount of cash, swapping, by the hardware processor, the first and second amounts of cash.

According to another embodiment, a system includes a first automatic teller machine, a second automatic teller machine, and an exception handler comprising a memory and a hardware processor communicatively coupled to the memory. The hardware processor receives, from a servicer, a message indicating that a first amount of cash was counted in the first automatic teller machine and that the first automatic teller machine should contain a third amount of cash based on transactions processed by the first automatic teller machine and receives, from the servicer, a message that a second amount of cash was counted in the second automatic teller machine and that the second automatic teller machine should contain a fourth amount of cash based on transactions processed by the second automatic teller machine. The hardware processor also determines that the first amount of cash is different from the third amount of cash, determines that the second amount of cash is different from the fourth amount of cash, and determines that the first and second amounts of cash were counted by the servicer. In response to determining that the first amount of cash is different from the third amount of cash, that the second amount of cash is different from the fourth amount of cash, and that the first and second amounts of cash were counted by the servicer, the hardware processor determines that a difference between the first amount of cash and the third amount of cash is the same as a difference between the second amount of cash and the fourth amount of cash and in response to determining that the difference between the first amount of cash and the third amount of cash is the same as the difference between the second amount of cash and the fourth amount of cash, swaps the first and second amounts of cash.

Certain embodiments provide one or more technical advantages. For example, an embodiment automatically detects and resolves false positive ATM exceptions. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
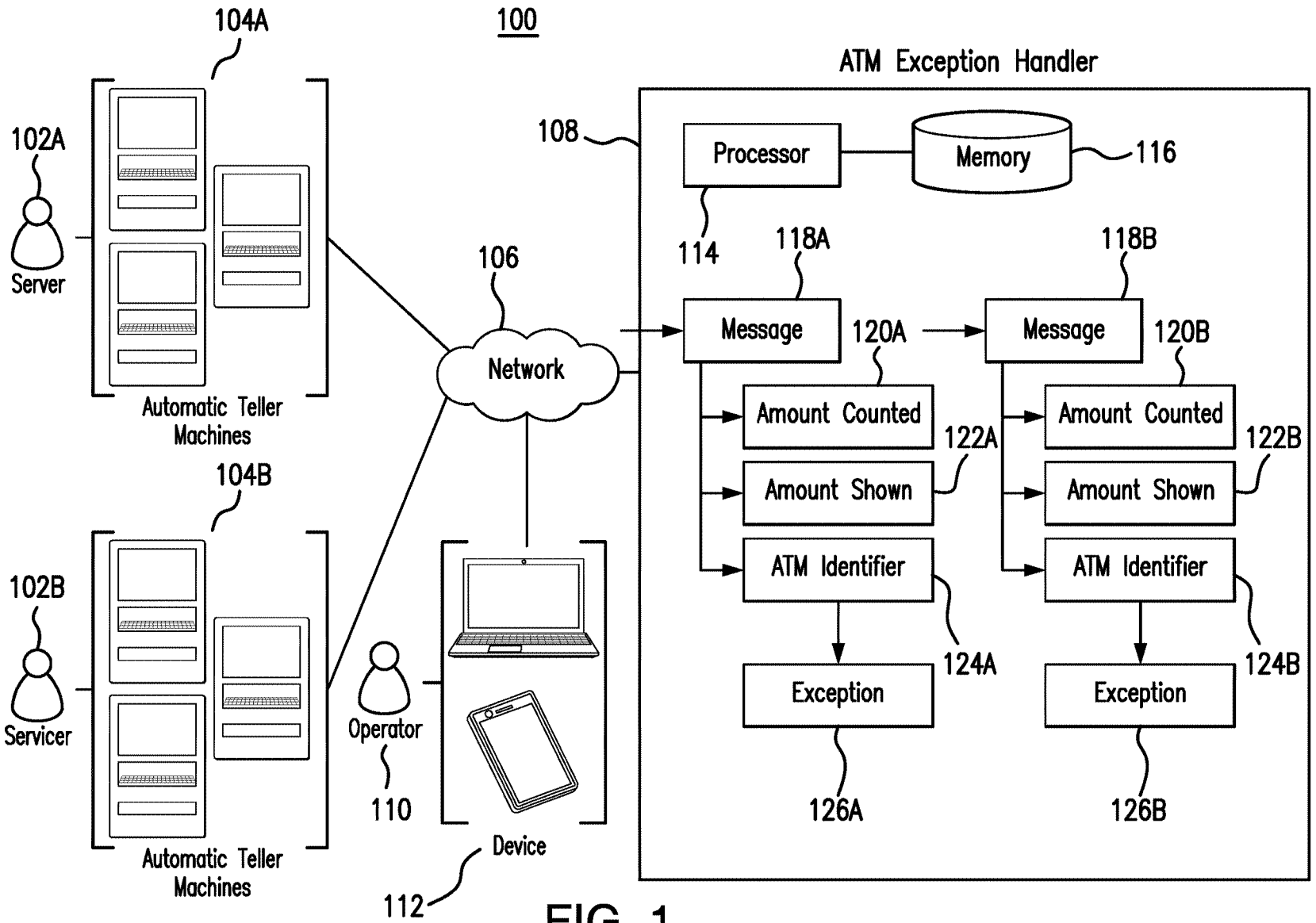
FIG. 1 illustrates an example system.
Figure 2:
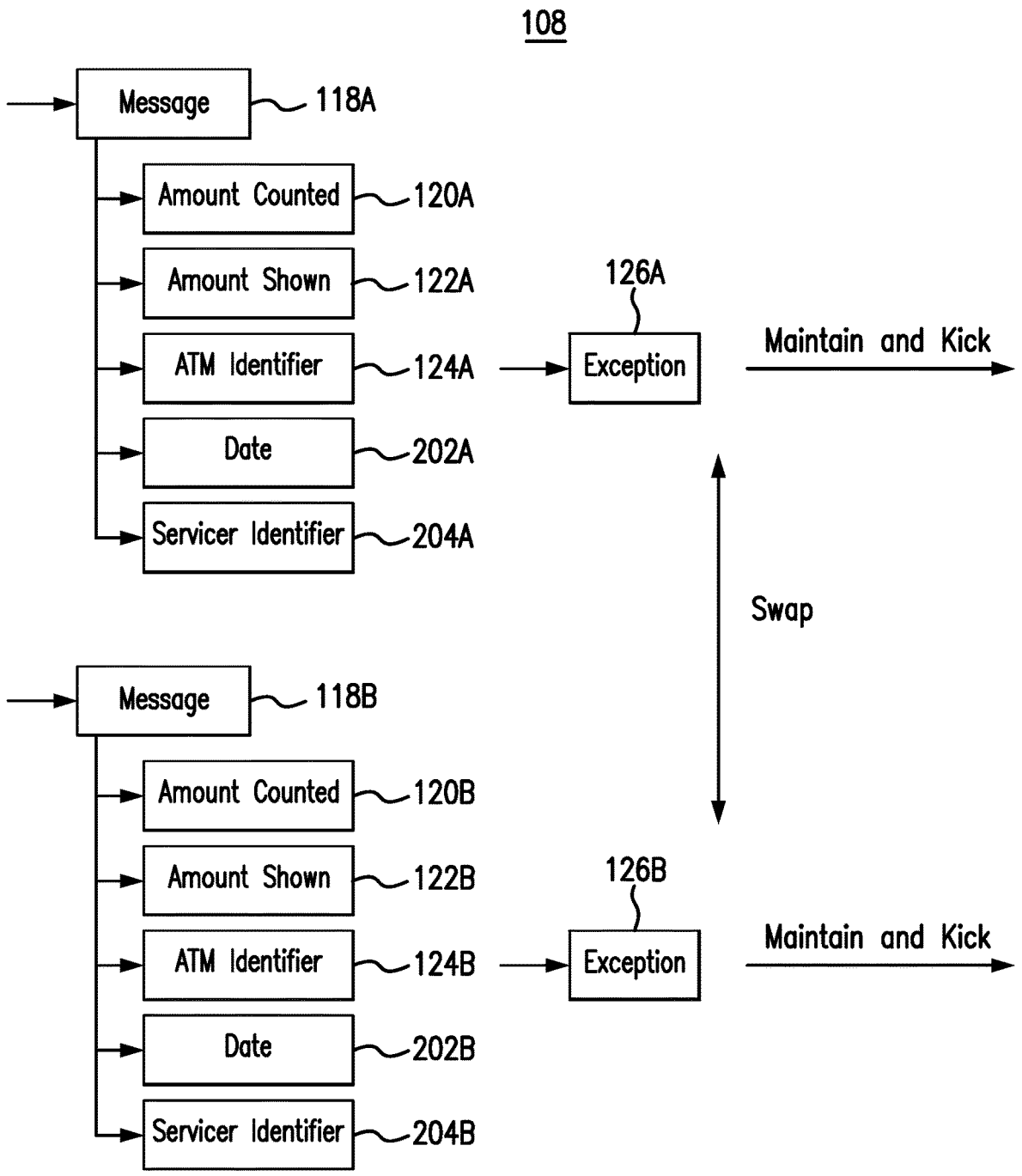
FIG. 2 illustrates an example ATM exception handler of the system of FIG. 1.
Figure 3:
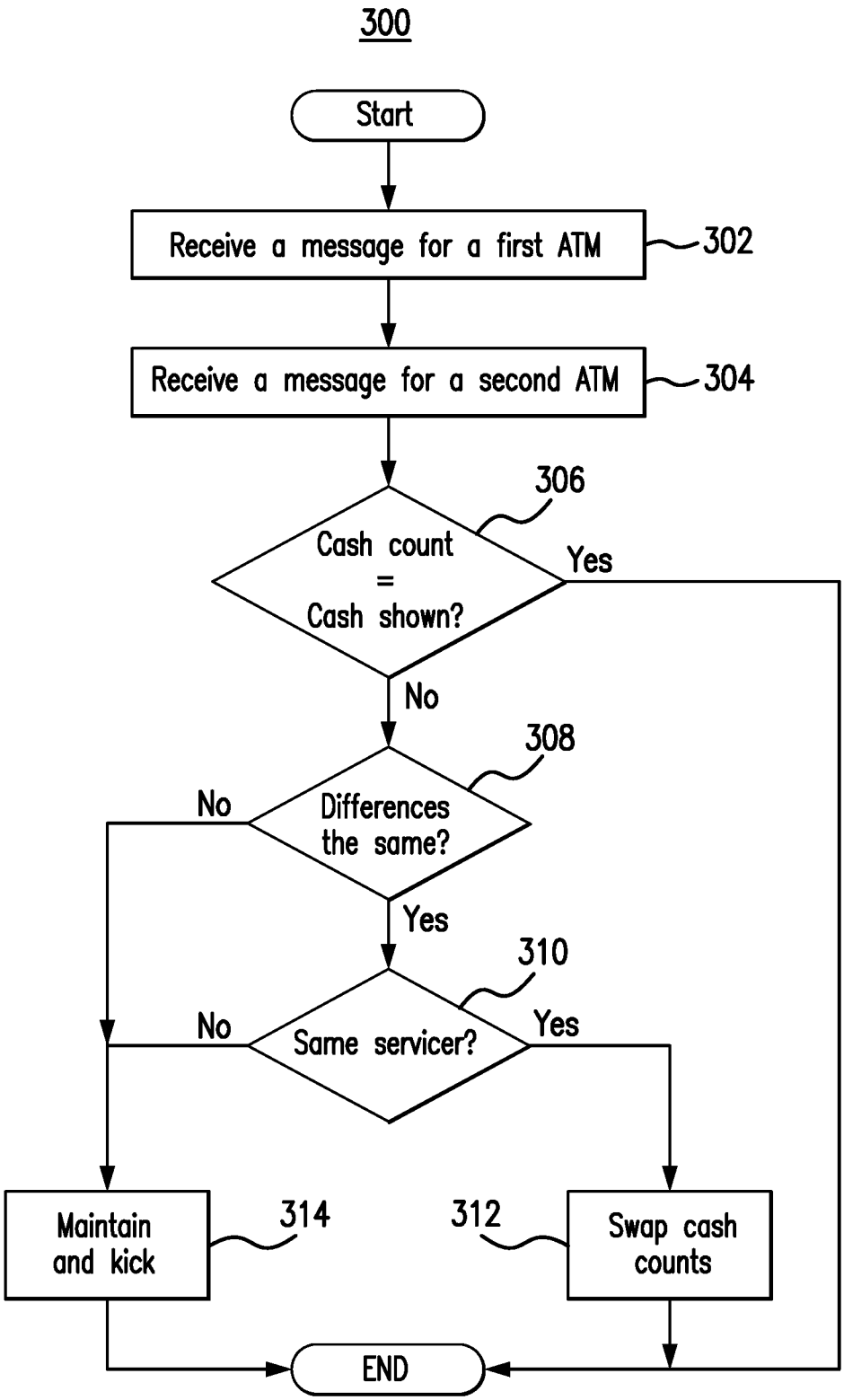
FIG. 3 is a flowchart illustrating a method for handling exceptions using the system of FIG. 1.

Embodiments of the present disclosure and its advantages are best understood by referring to FIGS. 1 through 3 of the drawings, like numerals being used for like and corresponding parts of the various drawings.

Automatic teller machines (ATMs) are machines that hold and dispense cash. Users may approach an ATM and withdraw cash from the ATM or deposit cash into the ATM. The ATM updates an account of the user depending on the actions taken by the user. ATMs typically include a physical repository within the ATM that stores the cash. The ATMs track the amount of money in the repository and update that amount depending on the transactions that have occurred at the ATM.

ATMs are serviced so that they do not run out of cash and so that deposited cash can be removed and taken to a processing facility. For example, servicers may drive armored trucks to ATMs to replenish the cash in the ATM and to remove deposited cash. These servicers may physically count the amount of cash in the ATM at the time of servicing and compare that amount to the amount of cash the ATM believes should be in the ATM based on the transactions that have occurred.

The servicers report the amount of cash counted and amount of cash shown by the ATM to an owner of the ATM to report the servicing. The owner of the ATM can then detect discrepancies between the amount of cash counted and the amount of cash shown. These discrepancies are a form of exception and should be handled and resolved. Servicers, however, may misreport the amount of cash counted and the amount of cash shown. Additionally, servicers may service ATMs in bulk (e.g., several ATMs at the same physical site) before reporting and, as a result, the servicer may attribute amounts of cash to the incorrect ATMs even though these amounts may be correct. As a result, it becomes technically challenging to determine when exceptions are truly exceptions and when they are false positives.

This disclosure contemplates an ATM exception handler that automatically handles certain forms of exceptions. The exception handler receives messages indicating amounts of cash counted and amounts of cash shown at different ATMs. If exceptions are indicated by these messages, the exception handler attempts to reconcile exceptions with each other depending on several factors, such as, the servicer of the ATMs and day of servicing. By reconciling exceptions with each other, the exception handler automatically detects and resolves false positives.

A practical application of the ATM exception handler is that the ATM exception handler automatically detects and resolves certain false positive ATM exceptions. In this manner, computing resources (e.g., processor, memory, and/or network resources) are not wasted handling false positives. By reducing the number of false positive exceptions, the exception handler can more quickly and efficiently handle true exceptions. The system will be described in more detail using FIGS. 1 through 3.

FIG. 1 illustrates an example system 100. As seen in FIG. 1, system 100 includes one or more automatic teller machines (ATMs) 104, a network 106, an ATM exception handler 108 and one or more devices 112. Generally, system 100 automatically detects and resolves exceptions that occur in ATMs 104 based on servicers 102 of ATMs 104. In particular embodiments, system 100 reduces the number of false positive exceptions in ATMs 104, which reduces the amount of computing resources used to resolve exceptions.

Automatic teller machines 104 hold and dispense cash. A user may use ATMs 104 to deposit or withdraw cash from an account. ATMs 104 include any suitable number of interfaces through which the user interacts with the ATM 104, such as for example, buttons, keyboards, touchpads, touchscreens, speakers, microphones, cameras, etc. ATMs 104 may include a physical repository in which cash for the ATM 104 is stored. As cash 104 is deposited into or withdrawn from ATM 104, ATM 104 tracks and updates the amount of cash that ATM 104 believes it to be holding.

Periodically, a servicer 102 will service an ATM 104. Servicer 102 may be an owner of the ATM 104 or a third party. For example, servicer 102 may drive an armored truck to the ATM 104 to service the ATM 104 (e.g., to replenish the cash in ATM 104). During servicing, servicer 102 may count the physical cash within ATM 104. Servicer 102 may also note the amount of cash that ATM 104 believes it to be holding. Servicer 102 may then communicate this information to an owner of ATM 104 for tracking and resolving. Sometimes, the amount of cash that servicer 102 counts in ATM 104 does not match the amount of cash that ATM 104 believes it should be holding. These mismatches are considered an exception and should be resolved to determine whether a problem occurred in the ATM 104.

Servicer 102 may service a group of ATMs 104. In the example of FIG. 1, servicer 102A services ATMs 104A and servicer 102B services ATMs 104B. ATMs 104 may be grouped for a particular servicer 102 based on any number of suitable factors, such as, for example, geographic location, traffic patterns, weather conditions, and time of servicing. For example, a servicer 102 may be assigned a group of ATMs that are all located at the same physical site. As another example, a servicer 102 may be assigned a group of ATMs that are located along a circular route.

Because a servicer 102 services multiple ATMs 104, false positive exceptions may occur. For example, servicer 102 may service a site that includes multiple ATMs 104. Servicer 102 may count the physical cash in each ATM 104 and then report these amounts at one time. However, servicer 102 may make a mistake and confuse which amounts of cash were stored in which ATMs 104. As another example, servicer 102 may confuse which ATMs 104 showed which amounts of cash that the ATMs 104 believed they should be holding. As a result, an exception will be detected in both scenarios, because the amount of cash counted in an ATM 104 will not match the amount of cash shown by the ATM 104. In these instances, computing resources (e.g., processor, memory, and network resources) are expended to resolve these false positive exceptions.

Network 106 allows communication between and amongst the various components of system 100. For example, ATMs 104, ATM exception handler 108, and devices 112 may communicate over network 106. This disclosure contemplates network 106 being any suitable network operable to facilitate communication between the components of system 100. Network 106 may include any interconnecting system capable of transmitting audio, video, signals, data, messages, or any combination of the preceding. Network 106 may include all or a portion of a public switched telephone network (PSTN), a public or private data network, a local area network (LAN), a metropolitan area network (MAN), a wide area network (WAN), a local, regional, or global communication or computer network, such as the Internet, a wireline or wireless network, an enterprise intranet, or any other suitable communication link, including combinations thereof, operable to facilitate communication between the components.

An operator 110 uses one or more devices 112 to resolve exceptions in ATMs 104. In conventional systems, exceptions are communicated to devices 112, and operator 110 attempts to determine the cause of the exception and to resolve the exception. The information is presented to operator 110 on an ATM-by-ATM basis, so operator 110 is left to consider the exceptions in each ATM 104 individually. As a result, certain exceptions will not be resolved properly and false positive exceptions may be treated like true exceptions.

Devices 112 include any appropriate device for communicating with components of system 100 over network 106. For example, devices 112 may be a telephone, a mobile phone, a computer, a laptop, a tablet, an automated assistant, and/or a cash register. This disclosure contemplates device 112 being any appropriate device for sending and receiving communications over network 106. As an example and not by way of limitation, device 112 may be a computer, a laptop, a wireless or cellular telephone, an electronic notebook, a personal digital assistant, a tablet, or any other device capable of receiving, processing, storing, and/or communicating information with other components of system 100. Device 112 may also include a user interface, such as a display, a microphone, keypad, or other appropriate terminal equipment usable by user 102. In some embodiments, an application executed by device 112 may perform the functions described herein.

ATM exception handler 108 automatically groups ATMs 104 based on the servicer 102 that serviced the ATMs 104. ATM exception handler 108 considers the exceptions generated in these ATMs 104 to automatically detect and resolve as many exceptions as possible. In this manner, the number of false positive exceptions are reduced in certain embodiments, which reduces the amount of computing resources used to resolve exceptions. ATM exception handler 108 includes a processor 114 and a memory 116. This disclosure contemplates processor 114 and memory 116 being configured to perform any of the functions or actions of ATM exception handler 108 described herein.

Processor 114 is any electronic circuitry, including, but not limited to microprocessors, application specific integrated circuits (ASIC), application specific instruction set processor (ASIP), and/or state machines, that communicatively couples to memory 116 and controls the operation of ATM exception handler 108. Processor 114 may be 8-bit, 16-bit, 32-bit, 64-bit or of any other suitable architecture. Processor 114 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 114 may include other hardware that operates software to control and process information. Processor 114 executes software stored on memory to perform any of the functions described herein. Processor 114 controls the operation and administration of ATM exception handler 108 by processing information received from devices 104, network 106, and memory 116. Processor 114 may be a programmable logic device, a microcontroller, a microprocessor, any suitable processing device, or any suitable combination of the preceding. Processor 114 is not limited to a single processing device and may encompass multiple processing devices.

Memory 116 may store, either permanently or temporarily, data, operational software, or other information for processor 114. Memory 116 may include any one or a combination of volatile or non-volatile local or remote devices suitable for storing information. For example, memory 116 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 116, a disk, a CD, or a flash drive. In particular embodiments, the software may include an application executable by processor 114 to perform one or more of the functions described herein.

ATM exception handler 108 receives one or more messages 118 from servicers 102. Each message 118 may include information pertaining to the servicing of an ATM 104, such as, for example, an amount of cash counted 120 in each ATM 104, an amount of cash shown 122 by each ATM 104, and an ATM identifier 124 for each ATM 104. In the example of FIG. 1, ATM exception handler 108 receives a message 118A and a message 118B. Message 118A includes an amount counted 120*a*, an amount shown 122*a* and an ATM identifier 124*a*. Message 118B includes an amount counted 120*b*, an amount shown 122*b* and an ATM identifier 124*b*.

ATM exception handler 108 may detect an exception 126 for each ATM 104 pertaining to message 118A and message 118B. For example, exception 126A may be generated because amount counted 120A is different from amount shown 122A. Additionally, exception 126B may be generated because amount counted 120B is different from amount shown 122B. In conventional systems, operator 110 may be tasked with resolving exceptions 126A and 126B individually and without context. ATM exception handler 108, however, considers the context in which exceptions 126A and 126B were generated to resolve these exceptions 126A and 126B, in certain embodiments. Generally, ATM exception handler 108 groups ATMs 104 based on the servicers 102 that service those ATMs 104. ATM exception handler 108 then considers the exceptions 126 for that group of ATMs 104 to see if any of the exceptions 126 offset each other, thus indicating a false positive exception 126. ATM exception handler 108 then automatically resolves these false positive exceptions 126 to reduce the number of false positive exceptions 126 and to reduce the computing resources expended to resolve false positive exceptions 126.

FIG. 2 illustrates an example ATM exception handler 108 of the system 100 of FIG. 1. Generally, ATM exception handler 108 determines whether an exception 126 exists and then automatically attempts to resolve the exception 126. Importantly, if the exception 126 is a false positive exception 126, ATM exception handler 108 may detect the false positive exception 126 and automatically resolve the false positive exception 126. In particular embodiments, by automatically detecting or resolving false positives exceptions 126, ATM exceptional handler 108 reduces the amount of computing resources used to handle and resolve exceptions 126.

ATM exception handler 108 receives one or more messages 118 from one or more servicers 102 of ATMs 104. Each message 118 provides information related to the servicing of an ATM 104. In the example of FIG. 2, ATM exception handler 108 receives a message 118A and a message 118B. Message 118A shows an amount of cash counted 120A by the servicer 102A in an ATM 104A, an amount of cash shown 122A by the ATM 104 (e.g., an amount of cash that ATM 104 believes it to be holding), an identifier 124A for the ATM 104, a date 202A of the servicing, and an identifier 204A of the servicer 102. Message 118B indicates an amount of cash counted 120B in another ATM 104, an amount of cash shown 122B by that ATM 104, an identifier 124B of that ATM 104, a date 202B of the servicing, and an identifier 204B of the servicer 102 who serviced that ATM 104.

ATM exception handler 108 may detect exceptions 126 based on messages 118. In the example of FIG. 2, ATM exception handler 108 determines that an exception 126A occurred based on message 118A and that an exception 126B occurred based on message 118B. For example, ATM exception handler 108 may determine that exception 126A occurred because amount counted 120A is different from amount shown 122A. As another example, ATM exception handler 108 may determine that exception 126B occurred because amount counted 120B is different from amount shown 122B. ATM exception handler 108 may automatically resolve exceptions 126 in a number of ways based on any of a number of factors. If ATM exception handler 108 does not resolve an exception 126, ATM exception handler 108 maintains the exception 126 and kicks the exception 126 to an operator 110 for the operator 110 to resolve the exception 126. Several examples of ATM exception handler 108 resolving exceptions 126 are provided below.

In a first example, ATM exception handler 108 may resolve exceptions 126A and 126B based on the servicer 102. ATM exception handler 108 may determine that a difference between amount counted 120A and amount shown 122A is the same as a difference between the amount counted 120B and amount shown 122B. ATM exception handler 108 may also determine that servicer identifier 204A is the same as servicer identifier 204B, which indicates that the same servicer 102 serviced the ATM 104 associated with message 118A and the ATM 104 associated with message 118B. These determinations may indicate that the servicer 102 mistakenly swapped amount counted 120A with amount counted 120B or amount shown 122A with amount shown 122B. In response, ATM exception handler 108 may resolve exceptions 126A and 126B by swapping one of amount counted 120A with amount counted 120B or amount shown 122A with amount shown 122B. After performing one of these swaps, ATM exception handler 108 may consider exceptions 126A and 126B resolved. In this manner, operator 110 need not review and resolve exceptions 126A and 126B. If servicer identifier 204A does not match servicer identifier 204B, ATM exception handler 108 may determine that, because the same servicer 102 did not service the ATMs 104 associated with messages 118A and 118B, the amount shown in messages 118A and 118B were not mistakenly swapped. In response, ATM exception handler 108 may maintain both exceptions 126A and 126B and kick both exceptions 126A and 126B to operator 110 to resolve exceptions 126A and 126B.

As another example, ATM exception handler 108 may further consider the dates 202 of servicing to determine whether exceptions 126A and 126B can be resolved with each other. ATM exception handler 108 may determine that a difference between amount counted 120A and amount shown 122A is the same as a difference between amount counted 120B and amount shown 122B. ATM exception handler 108 may also determine that servicer identifier 204A is the same as servicer identifier 204B which indicates that the same servicer 102 serviced the ATMs 104 associated with messages 118A and 118B. If date 202A matches date 202B, then ATM exception handler 108 may determine that the servicer 102 had mistakenly swapped one of amount counted 120A with amount counted 120B or amount shown 122A with amount shown 122B. In response, ATM exception handler 108 may swap one of amount counted 120A with amount counted 120B or amount shown 122A with amount shown 122B. ATM exception handler 108 may then consider exceptions 126A and 126B resolved. If date 202A does not match date 202B, then ATM exception handler 108 may determine that, because the servicings took place on different days, the servicer did not mistakenly swap any of the amounts shown in messages 118A and 118B. In response, ATM exception handler 108 may maintain both exceptions 126A and 126B and kick both exceptions 126A and 126B to an operator 110 to resolve the exceptions 126A and 126B.

In a third example, ATM exception handler 108 may determine that a difference between amount counted 120A and amount shown 122A is the same as a difference between amount counted 120B and amount shown 122B. ATM exception handler 108 may also determine that ATM identifier 124A is the same as ATM identifier 124B. Servicer identifier 204A may be the same as or different from servicer identifier 204B. ATM exception handler 108 may further determine that date 202A is different from date 202B. As a result, ATM exception handler 108 may determine that messages 118A and 118B indicate that a servicer 102 miscounted the amount of cash in ATM 104 on the first day but then the servicer 102 or another servicer 102 correctly counted the cash in that ATM 104 on another day. In response, ATM exception handler 108 may determine that the amount counted 120 on the subsequent day is the correct amount and resolve exceptions 126A and 126B. In this manner, an operator 110 need not analyze exceptions 126A and 126B.

Although several examples of resolving ATM exceptions 126 have been provided, ATM exception handler 108 may resolve exceptions 126 in a myriad of ways using any suitable number of factors. In particular embodiments, by automatically resolving exceptions 126, ATM exception handler 108 reduces the computing resources (e.g., processor, memory, and/or network resources) used to resolve exceptions 126.

FIG. 3 is a flowchart illustrating a method 300 for handling exceptions 126 using the system 100 of FIG. 1. Generally, ATM exception handler 108 performs the steps of method 300. In particular embodiments, by performing method 300, ATM exception handler 108 reduces the amount of computing resources used to analyze and resolve exceptions 126.

ATM exception handler 108 begins by receiving a message 118A for a first ATM 104. Message 118A may provide information associated with the servicing of the first ATM 104 such as, for example, an amount of cash counted 120A in the first ATM 104, an amount of cash shown 122A by the first ATM 104, an identifier 124A for the first ATM 104, a date 202A of the servicing, and an identifier 204A of the servicer 102 who service the first ATM 104. ATM exception handler 108 receives a message 118B for a second ATM 104 in step 304. Message 118B may provide information associated with the servicing of the second ATM 104 such as, for example, an amount of cash counted 120B in the second ATM 104, an amount of cash shown 122B by the second ATM 104, an identifier 124B of the second ATM 104, a date 202B of the servicing, and an identifier 204B of the servicer 102 who serviced the second ATM 104.

In step 306, ATM exception handler 108 may determine whether the amount of cash counted 120 in an ATM 104 is the same as the amount of cash shown 122 by that ATM 104. If the amount of cash counted 120 is the same as the amount of cash shown 122, then ATM exception handler 108 may determine that no exception 126 occurred and conclude.

If ATM exception handler 108 determines that the amount of cash counted 120 does not equal the amount of cash shown 122 in ATM 104 then ATM exception handler 108 may determine that an exception 126 occurred. In step 308, ATM exception handler 108 may determine whether two ATMs 104 have the same difference between the amount of cash counted 120 and the amount of cash shown 122 for that ATM 104. If two ATMs 104 do not have the same difference, then ATM exception handler 108 may maintain the exceptions 126 and kick the exceptions 126 to an operator 110 to analyze and resolve the exceptions 126 in step 314. If the differences for two ATMs 104 are the same, then ATM exception handler 108 determines in step 310 whether the two ATMs 104 were serviced by the same servicer 102 using the service identifiers 204. If the two ATMs 104 were not serviced by the same servicer 102, then ATM exception handler 108 maintains the exceptions 126 and kicks the exceptions 126 to operator 110 to analyze and resolve the exceptions 126 in step 314. If the two ATMs 104 had the same servicer 102, then ATM exception handler 108 swaps the amount of cash counted 120 for the two ATMs 104 in step 312.

Modifications, additions, or omissions may be made to method 300 depicted in FIG. 3. Method 300 may include more, fewer, or other steps. For example, steps may be performed in parallel or in any suitable order. While discussed as ATM exception handler 108 performing the steps, any suitable component of system 100, such as device(s) 104 for example, may perform one or more steps of the methods.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a memory; and a hardware processor communicatively coupled to the memory, the hardware processor configured to:

receive a message indicating that a first amount of cash was counted in a first automatic teller machine and that the first automatic teller machine should contain a third amount of cash based on transactions processed by the first automatic teller machine, wherein the first amount of cash is different from the third amount of cash;

receive a message that a second amount of cash was counted in a second automatic teller machine and that the second automatic teller machine should contain a fourth amount of cash based on transactions processed by the second automatic teller machine, wherein the second amount of cash is different from the fourth amount of cash;

determine that a difference between the first amount of cash and the third amount of cash is the same as a difference between the second amount of cash and the fourth amount of cash; and in response to determining that the difference between the first amount of cash and the third amount of cash is the same as the difference between the second amount of cash and the fourth amount of cash, swap the first and second amounts of cash.

2. The apparatus of claim 1, the hardware processor further configured to:

receive a message indicating that a fifth amount of cash was counted in the first automatic teller machine on a first day and that the first automatic teller machine should contain a seventh amount of cash on the first day based on transactions processed by the first automatic teller machine;

receive a message indicating that a sixth amount of cash was counted in the second automatic teller machine on a second day different from the first day and that the second automatic teller machine should contain an eighth amount of cash on the second day based on transactions processed by the second automatic teller machine;

determine that the fifth amount of cash is different from the seventh amount of cash;

determine that the sixth amount of cash is different from the eighth amount of cash; and in response to determining that the first day is not the same as the second day, maintain the fifth amount of cash and the sixth amount of cash even if a difference between the fifth amount of cash and the seventh amount of cash is the same as a difference between the sixth amount of cash and the eighth amount of cash.

3. The apparatus of claim 2, the hardware processor further configured to communicate the difference between the fifth amount of cash and the seventh amount of cash and the difference between the sixth amount of cash and the eighth amount of cash to a human operator in response to determining that the first day is not the same as the second day.

4. The apparatus of claim 1, the hardware processor further configured to:

receive a message indicating that a fifth amount of cash was counted in the first automatic teller machine on a first day and that the first automatic teller machine should contain a seventh amount of cash on the first day based on transactions processed by the first automatic teller machine;

receive a message that a sixth amount of cash was counted in the first automatic teller machine on a second day different from the first day and that the first automatic teller machine should contain an eighth amount of cash on the second day based on transactions processed by the first automatic teller machine;

determine that the fifth amount of cash is different from the seventh amount of cash;

determine that the sixth amount of cash is different from the eighth amount of cash;

determine that a difference between the fifth amount of cash and the seventh amount of cash is the same as a difference between the eighth amount of cash and the sixth amount of cash;

in response to determining that the difference between the fifth amount of cash and the seventh amount of cash is the same as the difference between the eighth amount of cash and the sixth amount of cash and that the second day is different from the first day, determine that the sixth amount of cash is the correctly counted amount of cash in the first automatic teller machine.

5. The apparatus of claim 1, the hardware processor further configured to group the first automatic teller machine and the second automatic teller machine with a third automatic teller machine in response to determining that the first, second, and third automatic teller machines were serviced by a common servicer.

6. The apparatus of claim 1, the hardware processor further configured to:

receive, from a servicer, a message indicating that a fifth amount of cash was counted in the first automatic teller machine and that the first automatic teller machine should contain a seventh amount of cash based on transactions processed by the first automatic teller machine;

receive, from a second servicer different from the servicer, a message indicating that a sixth amount of cash was counted in the second automatic teller machine and that the second automatic teller machine should contain an eighth amount of cash based on transactions processed by the second automatic teller machine;

determine that the fifth amount of cash is different from the seventh amount of cash;

determine that the sixth amount of cash is different from the eighth amount of cash; and in response to determining that the servicer is not the same as the second servicer, maintain the fifth amount of cash and the sixth amount of cash even if a difference between the fifth amount of cash and the seventh amount of cash is the same as a difference between the sixth amount of cash and the eighth amount of cash.

7. The apparatus of claim 6, the hardware processor further configured to communicate the difference between the fifth amount of cash and the seventh amount of cash and the difference between the sixth amount of cash and the eighth amount of cash to a human operator in response to determining that the servicer is not the same as the second servicer.

8. A method comprising:

receiving, by a hardware processor communicatively coupled to a memory, a message indicating that a first amount of cash was counted in a first automatic teller machine and that the first automatic teller machine should contain a third amount of cash based on transactions processed by the first automatic teller machine, wherein the first amount of cash is different from the third amount of cash;

receiving, by the hardware processor, a message that a second amount of cash was counted in a second automatic teller machine and that the second automatic teller machine should contain a fourth amount of cash based on transactions processed by the second automatic teller machine, wherein the second amount of cash is different from the fourth amount of cash;

determining, by the hardware processor, that a difference between the first amount of cash and the third amount of cash is the same as a difference between the second amount of cash and the fourth amount of cash; and in response to determining that the difference between the first amount of cash and the third amount of cash is the same as the difference between the second amount of cash and the fourth amount of cash, swapping, by the hardware processor, the first and second amounts of cash.

9. The method of claim 8, further comprising:

receiving, by the hardware processor, a message indicating that a fifth amount of cash was counted in the first automatic teller machine on a first day and that the first automatic teller machine should contain a seventh amount of cash on the first day based on transactions processed by the first automatic teller machine;

receiving, by the hardware processor, a message indicating that a sixth amount of cash was counted in the second automatic teller machine on a second day different from the first day and that the second automatic teller machine should contain an eighth amount of cash on the second day based on transactions processed by the second automatic teller machine;

determining, by the hardware processor, that the fifth amount of cash is different from the seventh amount of cash;

determining, by the hardware processor, that the sixth amount of cash is different from the eighth amount of cash; and in response to determining that the first day is not the same as the second day, maintaining, by the hardware processor, the fifth amount of cash and the sixth amount of cash even if a difference between the fifth amount of cash and the seventh amount of cash is the same as a difference between the sixth amount of cash and the eighth amount of cash.

10. The method of claim 9, further comprising communicating, by the hardware processor, the difference between the fifth amount of cash and the seventh amount of cash and the difference between the sixth amount of cash and the eighth amount of cash to a human operator in response to determining that the first day is not the same as the second day.

11. The method of claim 8, further comprising:

receiving, by the hardware processor, a message indicating that a fifth amount of cash was counted in the first automatic teller machine on a first day and that the first automatic teller machine should contain a seventh amount of cash on the first day based on transactions processed by the first automatic teller machine;

receiving, by the hardware processor, a message that a sixth amount of cash was counted in the first automatic teller machine on a second day different from the first day and that the first automatic teller machine should contain an eighth amount of cash on the second day based on transactions processed by the first automatic teller machine;

determining, by the hardware processor, that the fifth amount of cash is different from the seventh amount of cash;

determining, by the hardware processor, that the sixth amount of cash is different from the eighth amount of cash;

determining, by the hardware processor, that a difference between the fifth amount of cash and the seventh amount of cash is the same as a difference between the sixth amount of cash and the eighth amount of cash;

in response to determining that the difference between the fifth amount of cash and the seventh amount of cash is the same as the difference between the sixth amount of cash and the eighth amount of cash, swapping, by the hardware processor, the fifth amount of cash and the sixth amount of cash even though the first day is different from the second day.

12. The method of claim 8, further comprising grouping, by the hardware processor, the first automatic teller machine and the second automatic teller machine with a third automatic teller machine in response to determining that the first, second, and third automatic teller machines were serviced by a common servicer.

13. The method of claim 8, further comprising:

receiving, by the hardware processor and from a servicer, a message indicating that a fifth amount of cash was counted in the first automatic teller machine and that the first automatic teller machine should contain a seventh amount of cash based on transactions processed by the first automatic teller machine;

receiving, by the hardware processor and from a second servicer different from the servicer, a message indicating that a sixth amount of cash was counted in the second automatic teller machine and that the second automatic teller machine should contain an eighth amount of cash based on transactions processed by the second automatic teller machine;

determining, by the hardware processor, that the fifth amount of cash is different from the seventh amount of cash;

determining, by the hardware processor, that the sixth amount of cash is different from the eighth amount of cash; and in response to determining that the servicer is not the same as the second servicer, maintaining, by the hardware processor, the fifth amount of cash and the sixth amount of cash even if a difference between the fifth amount of cash and the seventh amount of cash is the same as a difference between the sixth amount of cash and the eighth amount of cash.

14. The method of claim 13, further comprising communicating, by the hardware processor, the difference between the fifth amount of cash and the seventh amount of cash and the difference between the sixth amount of cash and the eighth amount of cash to a human operator in response to determining that the servicer is not the same as the second servicer.

15. A system comprising:

a first automatic teller machine;

a second automatic teller machine; and an exception handler comprising a memory and a hardware processor communicatively coupled to the memory, the hardware processor configured to:

receive a message indicating that a first amount of cash was counted in the first automatic teller machine and that the first automatic teller machine should contain a third amount of cash based on transactions processed by the first automatic teller machine, wherein the first amount of cash is different from the third amount of cash;

receive a message that a second amount of cash was counted in the second automatic teller machine and that the second automatic teller machine should contain a fourth amount of cash based on transactions processed by the second automatic teller machine, wherein the second amount of cash is different from the fourth amount of cash;

determine that a difference between the first amount of cash and the third amount of cash is the same as a difference between the second amount of cash and the fourth amount of cash; and in response to determining that the difference between the first amount of cash and the third amount of cash is the same as the difference between the second amount of cash and the fourth amount of cash, swap the first and second amounts of cash.

16. The system of claim 15, the hardware processor further configured to:

receive a message indicating that a fifth amount of cash was counted in the first automatic teller machine on a first day and that the first automatic teller machine should contain a seventh amount of cash on the first day based on transactions processed by the first automatic teller machine;

receive a message indicating that a sixth amount of cash was counted in the second automatic teller machine on a second day different from the first day and that the second automatic teller machine should contain an eighth amount of cash on the second day based on transactions processed by the second automatic teller machine;

determine that the fifth amount of cash is different from the seventh amount of cash;

determine that the sixth amount of cash is different from the eighth amount of cash; and in response to determining that the first day is not the same as the second day, maintain the fifth amount of cash and the sixth amount of cash even if a difference between the fifth amount of cash and the seventh amount of cash is the same as a difference between the sixth amount of cash and the eighth amount of cash.

17. The system of claim 16, the hardware processor further configured to communicate the difference between the fifth amount of cash and the seventh amount of cash and the difference between the sixth amount of cash and the eighth amount of cash to a human operator in response to determining that the first day is not the same as the second day.

18. The system of claim 15, the hardware processor further configured to:

receive a message indicating that a fifth amount of cash was counted in the first automatic teller machine on a first day and that the first automatic teller machine should contain a seventh amount of cash on the first day based on transactions processed by the first automatic teller machine;

receive a message that a sixth amount of cash was counted in the first automatic teller machine on a second day different from the first day and that the first automatic teller machine should contain an eighth amount of cash on the second day based on transactions processed by the first automatic teller machine;

determine that the fifth amount of cash is different from the seventh amount of cash;

determine that the sixth amount of cash is different from the eighth amount of cash;

determine that a difference between the fifth amount of cash and the seventh amount of cash is the same as a difference between the sixth amount of cash and the eighth amount of cash;

in response to determining that the difference between the fifth amount of cash and the seventh amount of cash is the same as the difference between the sixth amount of cash and the eighth amount of cash, swap the fifth amount of cash and the sixth amount of cash even though the first day is different from the second day.

19. The system of claim 15, the hardware processor further configured to group the first automatic teller machine and the second automatic teller machine with a third automatic teller machine in response to determining that the first, second, and third automatic teller machines were serviced by a common servicer.

20. The system of claim 15, the hardware processor further configured to:

receive, from a servicer, a message indicating that a fifth amount of cash was counted in the first automatic teller machine and that the first automatic teller machine should contain a seventh amount of cash based on transactions processed by the first automatic teller machine;

receive, from a second servicer different from the servicer, a message indicating that a sixth amount of cash was counted in the second automatic teller machine and that the second automatic teller machine should contain an eighth amount of cash based on transactions processed by the second automatic teller machine;

determine that the fifth amount of cash is different from the seventh amount of cash;

determine that the sixth amount of cash is different from the eighth amount of cash; and in response to determining that the servicer is not the same as the second servicer, maintain the fifth amount of cash and the sixth amount of cash even if a difference between the fifth amount of cash and the seventh amount of cash is the same as a difference between the sixth amount of cash and the eighth amount of cash.

* * * * *